US011111668B2

(12) United States Patent
Yamamoto et al.

(10) Patent No.: US 11,111,668 B2
(45) Date of Patent: Sep. 7, 2021

(54) PARTITION PANEL HAVING LEG WITH ROTATION STOPPER

(71) Applicant: OKAMURA CORPORATION, Yokohama (JP)

(72) Inventors: Takayuki Yamamoto, Yokohama (JP); Akiyoshi Shiodera, Yokohama (JP)

(73) Assignee: OKAMURA CORPORATION, Yokohama (JP)

( * ) Notice: Subject to any disclaimer, the term of this patent is extended or adjusted under 35 U.S.C. 154(b) by 0 days.

(21) Appl. No.: 16/756,237

(22) PCT Filed: Oct. 19, 2018

(86) PCT No.: PCT/JP2018/039042
§ 371 (c)(1),
(2) Date: Apr. 15, 2020

(87) PCT Pub. No.: WO2019/078362
PCT Pub. Date: Apr. 25, 2019

(65) Prior Publication Data

US 2020/0284032 A1 Sep. 10, 2020

(30) Foreign Application Priority Data

Oct. 20, 2017 (JP) ..... JP2017-203983

(51) Int. Cl.
*E04B 2/74* (2006.01)

(52) U.S. Cl.
CPC ..... *E04B 2/7425* (2013.01); *E04B 2/7401* (2013.01); *E04B 2/7457* (2013.01); (Continued)

(58) Field of Classification Search
CPC .... E04B 2/7425; E04B 2/7401; E04B 2/7457; E04B 2002/7487; E04B 2002/7488; E04B 2002/749; E04B 2/7405
See application file for complete search history.

(56) References Cited

U.S. PATENT DOCUMENTS 1,435,785 A * 11/1922 Alexander ..... A47F 7/24 248/165
1,598,438 A * 8/1926 Hallowell ..... G09F 15/0056 40/606.01

(Continued)

FOREIGN PATENT DOCUMENTS

JP 11-253257 9/1999
JP 2003-096953 4/2003

(Continued)

OTHER PUBLICATIONS

International Search Report for Application No. PCT/JP2018/039042, dated Dec. 11, 2018.

*Primary Examiner* — Jessie T Fonseca
(74) *Attorney, Agent, or Firm* — Nixon Peabody LLP; Jeffrey L. Costellia

(57) ABSTRACT

This panel (1) has a panel body (10) and a leg (20) that supports the panel body (10). The leg (20) has a shaft (22) that is inserted into the panel body (10), and a leg body (21) to which the shaft (22) is fixed and that is disposed outside of the panel body (10). The leg body (21) is provided with a first rotation stopper (31) that is in direct contact with at least either one of the front face (10A) and the back face (10B) of a panel face of the panel body (10) and that stops rotation of the panel body (10) in one direction around the shaft (22), and a second rotation stopper (32) that is configured to stop the rotation of the panel body (10) in the direction opposite to the one direction.

6 Claims, 7 Drawing Sheets

(52) U.S. Cl.
CPC . *E04B 2002/749* (2013.01); *E04B 2002/7487* (2013.01); *E04B 2002/7488* (2013.01)

(56) References Cited

U.S. PATENT DOCUMENTS

| | | | | | |
|---|---|---|---|---|---|
| 3,494,405 | A * | 2/1970 | Bartelmas | G03B 21/58 | 160/24 |
| 3,583,466 | A * | 6/1971 | Dreyer | G03B 21/58 | 160/351 |
| 4,200,254 | A * | 4/1980 | Nelson | E04B 2/7405 | 160/351 |
| 4,784,205 | A * | 11/1988 | Johnson | A47G 5/00 | 160/328 |
| 4,942,709 | A * | 7/1990 | Waldron | E04B 2/7425 | 52/285.1 |
| 6,370,803 | B1 * | 4/2002 | Burquest | G09F 15/0025 | 40/607.04 |
| 9,260,910 | B1 * | 2/2016 | Flannery | E06B 9/00 | |
| D871,783 | S * | 1/2020 | Yamamoto | D6/332 | |
| 2008/0104907 | A1 * | 5/2008 | Glick | E04B 2/7425 | 52/239 |
| 2020/0347592 | A1 * | 11/2020 | Kuchman | E04B 2/7442 | |

FOREIGN PATENT DOCUMENTS

| | | |
|---|---|---|
| JP | 2007-032085 | 2/2007 |
| JP | 2016-079728 | 5/2016 |

* cited by examiner

PARTITION PANEL HAVING LEG WITH ROTATION STOPPER

TECHNICAL FIELD

The present invention relates to a panel.

Priority is claimed on Japanese Patent Application No. 2017-203983, filed Oct. 20, 2017, the content of which is incorporated herein by reference.

BACKGROUND ART

In working spaces such as offices and public facilities, partition panels may be installed in order to provide an environment in which workers' eyes are blocked so that the workers can concentrate. As such a panel, for example, Patent Document 1 and 2 below disclose a panel having a panel body and legs that support the panel body. The legs are installed to clamp both panel surfaces of the panel body to prevent falling over and rotation of the panel body.

CITATION LIST

Patent Document

[Patent Document 1]

Japanese Unexamined Patent Application, First Publication No. 2003-96953

[Patent Document 2]

Japanese Unexamined Patent Application, First Publication No. 2007-32085

SUMMARY OF INVENTION

Technical Problem

Incidentally, since the legs in the conventional technique are strength members for preventing falling over and rotation of the panel body, and they appear to be large on both panel surfaces of the panel body and give the impression of inorganic matter to the workers, there is a problem that the design characteristics of the panel body are inferior. On the other hand, when the size of the legs is reduced, there is concern that the strength for preventing falling over and rotation of the panel body may not be secured.

The present invention has been made in view of the above problems, and an object of the present invention is to provide a panel which has superior design characteristics and can prevent falling over and rotation of a panel body.

Solution to Problem

A panel according to the present invention employs the following constituents in order to solve the above problems.

A panel according to one aspect of the present invention is a panel having: a panel body; and a leg supporting the panel body, in which the leg has a shaft inserted into the panel body, and a leg body to which the shaft is fixed and which is disposed outside the panel body, and the leg body is provided with a first rotation stopper which is configured to come into contact with either one of both panel surfaces of the panel body and stop rotation of the panel body in one direction around the shaft, and a second rotation stopper which is configured to come into contact with either one of both panel surfaces of the panel body and stop rotation of the panel body in a direction opposite to the one direction.

According to this configuration, since the panel body is supported from the inside by the shaft of the leg inserted into the panel body, falling over of the panel body can be prevented. Also, since the shaft inserted into the panel body is invisible from the outside, superior design characteristics can be realized. Further, the function of preventing rotation of the panel body is ensured by the leg body disposed outside the panel body. The leg body is provided with the first rotation stopper which is configured to come into contact with either one of both panel surfaces of the panel body and stop rotation of the panel body in one direction around the shaft, and the second rotation stopper which is configured to come into contact with either one of both panel surfaces of the panel body and stop rotation of the panel body in a direction opposite to the one direction. Since the first rotation stopper and the second rotation stopper do not need to have a strength for preventing falling over of the panel body, and just need to secure a strength for preventing rotation of the panel body, their sizes can be reduced, thereby making them inconspicuous when viewed from the outside.

Also, in the panel body according to one aspect of the present invention, the first rotation stopper and the second rotation stopper figured to come into contact with a peripheral edge of the panel body.

According to this configuration, since the first rotation stopper and the second rotation stopper are arranged on the peripheral edge of the panel body, the first rotation stopper and the second rotation stopper can be more inconspicuous.

Also, in the panel body according to one aspect of the present invention, the first rotation stopper and the second rotation stopper extend substantially parallel to both surfaces of the peripheral edge and are connected to each other at a connection portion substantially parallel to an end surface of the peripheral edge.

According to this configuration, in a state in which the peripheral edge of the panel body is inserted between the first rotation stopper and the second rotation stopper, the end surface of the peripheral edge and the connection portion can come into contact with each other substantially in parallel, and an interval between the first rotation stopper and the second rotation stopper is kept constant by the connection portion. Accordingly, the first rotation stopper and the second rotation stopper can stably come into contact with both surfaces of the peripheral edge.

Also, in the panel body according to one aspect of the present invention, the first rotation stopper and the second rotation stopper stand upward in the same direction from the connection portion and form an engagement recess having the connection portion as a bottom surface.

According to this configuration, in a state in which the peripheral edge of the panel body is inserted into the engagement recess, the end surface of the peripheral edge and the connection portion forming the bottom surface of the engagement recess are located substantially at the same position. Accordingly, a design characteristic thereof is improved.

Also, the panel body according to one aspect of the present invention has a recess-shaped cover which covers the peripheral edge of the panel body and a connecting portion which connects the cover to the engagement recess.

According to this configuration, since the cover which covers the peripheral edge of the panel body can be connected continuously with the engagement recess, the design characteristic is improved while the peripheral edge is protected by the cover.

Also, in the panel body according to one aspect of the present invention, a pair of legs are provided with an interval therebetween in a width direction of the panel body, and the first rotation stopper and the second rotation stopper of each of the pair of legs extend in directions to face each other.

According to this configuration, since a shape of the pair of legs becomes symmetrical in the width direction of the panel body, an appearance thereof is good, and the panel body can be stably supported.

Advantageous Effects of Invention

According to the present invention, a panel Which has superior design characteristics and can prevent falling over and rotation of a panel body can be obtained.

DESCRIPTION OF EMBODIMENTS

Hereinafter, an embodiment according to one aspect of the present invention will be described with reference to the drawings.

Figure 1:
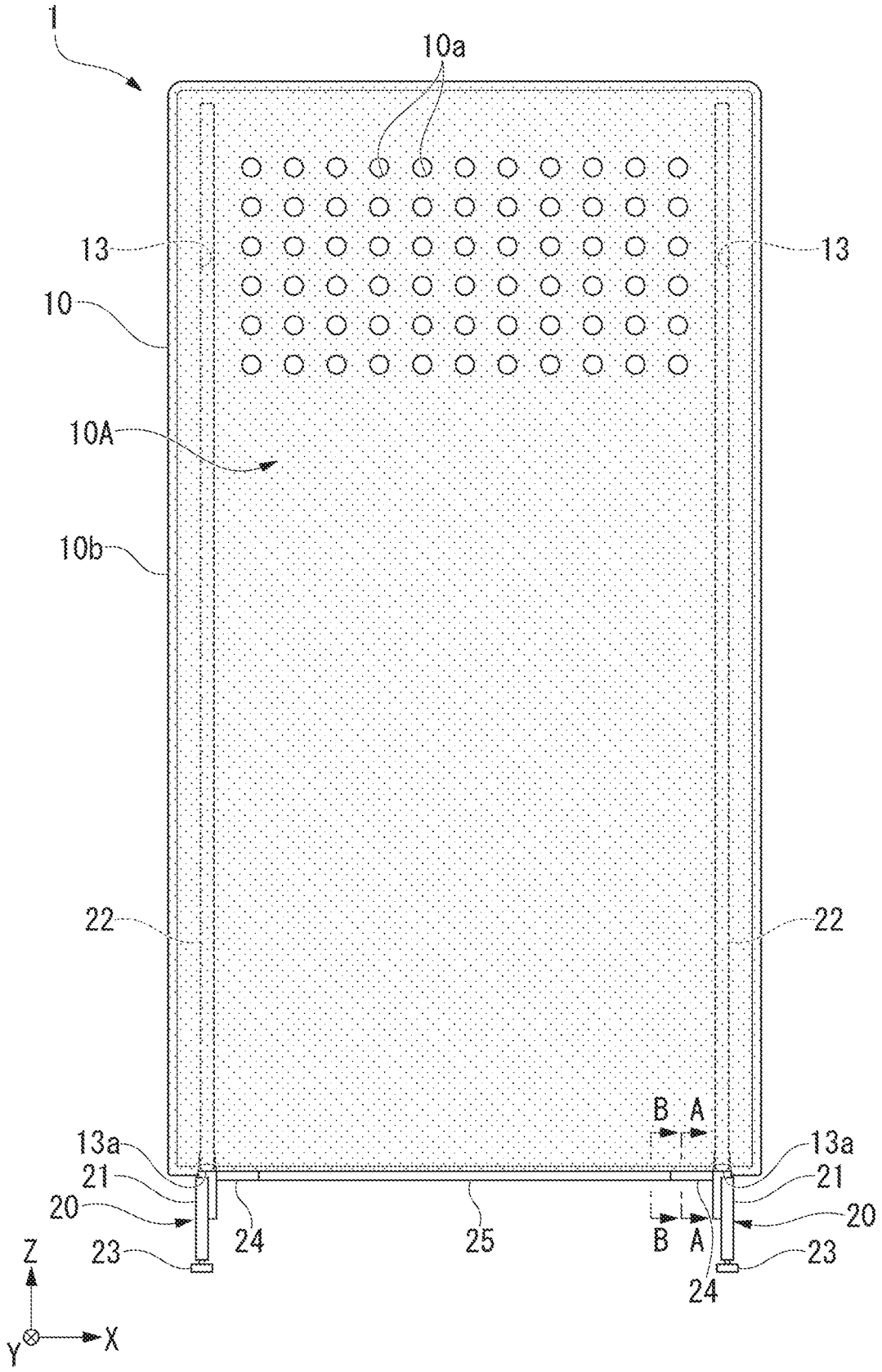
FIG. 1 is a front view of a panel 1 according to an embodiment of the present invention.
Figure 2:
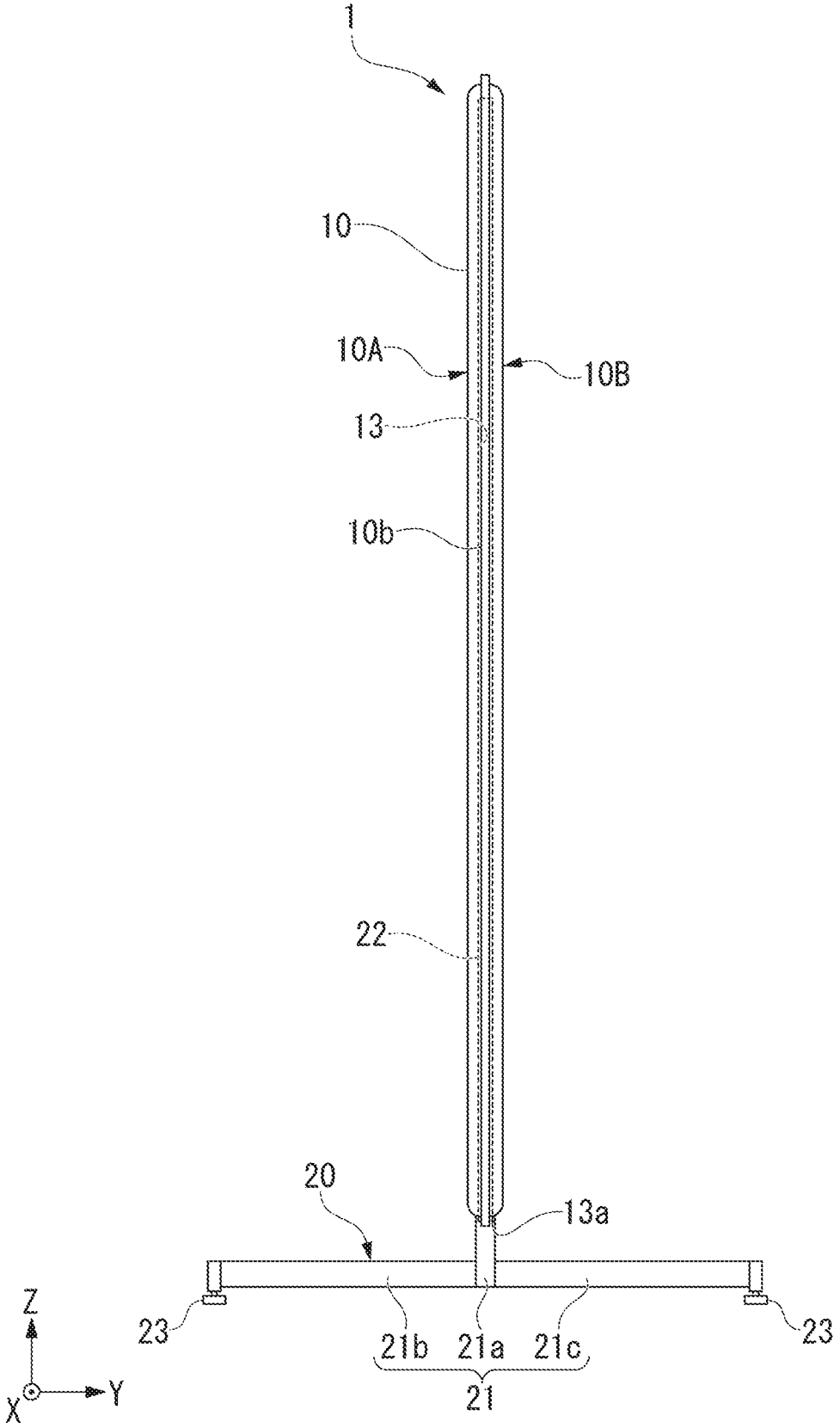
FIG. 2 is a right side view of the panel 1 according to the embodiment of the present invention.

FIG. 1 is a front view of a panel 1 according to the embodiment of the present invention. FIG. 2 is a right side view of the panel 1 according to the embodiment of the present invention.

The panel 1 is used, for example, to partition a working space (not shown). As shown in FIG. 1, the panel 1 has a panel body 10 and a pair of legs 20 which support the panel body 10.

Also, in the following description, an XYZ orthogonal coordinate system is set, and positional correlations between members may be described with reference to the XYZ orthogonal coordinate system. A predetermined direction in a horizontal plane is defined as an X axis direction. A direction orthogonal to the X axis direction in the horizontal plane is defined as a Y axis direction. A direction orthogonal to each of the X axis direction and the Y axis direction (that is, a vertical direction) is defined as a Z axis direction.

The panel body 10 is formed in a rectangular shape extending in the vertical direction (Z axis direction). A plurality of through holes 10*a* are formed in the panel body 10. The plurality of through holes 10*a* are formed in an upper portion of the panel body 10 in a region excluding both ends of the upper portion in a width direction (the X axis direction) thereof. The through holes 10*a* penetrate from a front surface 10A to a back surface 10B forming panel surfaces of the panel body 10 in a thickness direction (the Y axis direction) of the panel body 10. A peripheral edge 10*b* of the panel body 10 has a smaller thickness than those of other portions besides the peripheral edge 10*b*.

The panel body 10 is configured by, for example, laminating two nonwoven fabric sheets. A surface layer of the nonwoven fabric sheet is, for example, a polyester fabric, an inner cushion layer is, for example, a polyester solid cotton board, and both are integrated via, for example, a polyester-based binder nonwoven fabric. This nonwoven fabric sheet has superior design characteristics because it creates an organic and warm impression specific to a nonwoven fabric.

Further, fibers constituting the nonwoven fabric sheet include, in addition to polyester mentioned above, fibers made of polypropylene, polyethylene, etc., glass fibers, nylon fibers, carbon fibers, aramid fibers, and the like. As the fibers constituting the nonwoven fabric sheet, polyester fibers, nylon fibers or polypropylene fibers are preferred from the viewpoint of excellent decoration, moldability, texture, and availability. Also, as an adhesive layer for bonding the nonwoven fabric sheets to each other, for example, a nonwoven fabric such as polyester, polyethylene, polyamide and the like that contains a hot melt is preferable.

The panel body 10 has hollow portions 13 formed therein. The hollow portions 13 have rectangular shapes in cross-section and extend in a longitudinal direction (the Z axis direction) of the panel body 10. The hollow portions 13 are formed linearly along the longitudinal direction of the panel body 10 as shown in FIG. 1. In the longitudinal direction of the panel body 10, dimensions of the hollow portions 13 are slightly smaller than a dimension of the panel body 10. That is, the hollow portions 13 do not penetrate the panel body 10 in the longitudinal direction of the panel body 10. The hollow portions 13 have opening ends 13*a* at a lower end of the panel body 10. In a region in which the opening ends 13*a* are formed, the peripheral edge 10*b* is partially cut away (see FIG. 3 which will be described later).

On the other hand, the pair of legs 20 are made of a metal and support both ends of the panel body 10 in the width direction as shown in FIG. 1, Each of the pair of legs 20 has a leg body 21 disposed outside the panel body 10, and a shaft 22 which extends upward from the leg body 21 and is inserted into the panel body 10. As shown in FIG. 2, the leg body 21 has a fixing portion 21*a* to which the shaft 22 is fixed, a front leg 21*b* extending from the fixing portion 21*a* to the front surface 10A side of the panel body 10, and a rear leg 21*c* extending from the fixing portion 21*a* to the back surface 10B side of the panel body 10.

An adjuster 23 that comes into contact with a floor is attached to a tip portion of each of the front leg 21*b* and the rear leg 21*c*. The adjuster 23 includes, for example, a screw portion that can be screwed to each of the front leg 21*b* and the rear leg 21*c*, and is configured such that unevenness of the panel 1 can be adjusted by rotating the screw portion.

As shown in FIG. 2, the shaft 22 stands upward from a central portion (the fixing portion 21*a*) of the leg body 21 in a longitudinal direction (the Y axis direction) thereof. The shaft 22 is, for example, a hollow quadrangular pillar and is inserted into the hollow portion 13 formed inside the panel body 10. In the thickness direction (Y axis direction) of the panel body 10, a dimension of the shaft 22 is smaller than a dimension of the panel body 10 from the front surface 10A to the back surface 10B.

Further, as shown in FIG. 1, each leg body 21 is provided with an engagement recess 24 that engages with the peripheral edge 10*b* that forms a lower end side of the panel body 10. The engagement recess 24 functions as a rotation stopper that restricts relative rotation between the panel body 10 and the leg body 21 about the shaft 22. A cover 25 is attached to the peripheral edge 10*b* between the engagement recesses 24 of the pair of legs 20.

Figure 3:
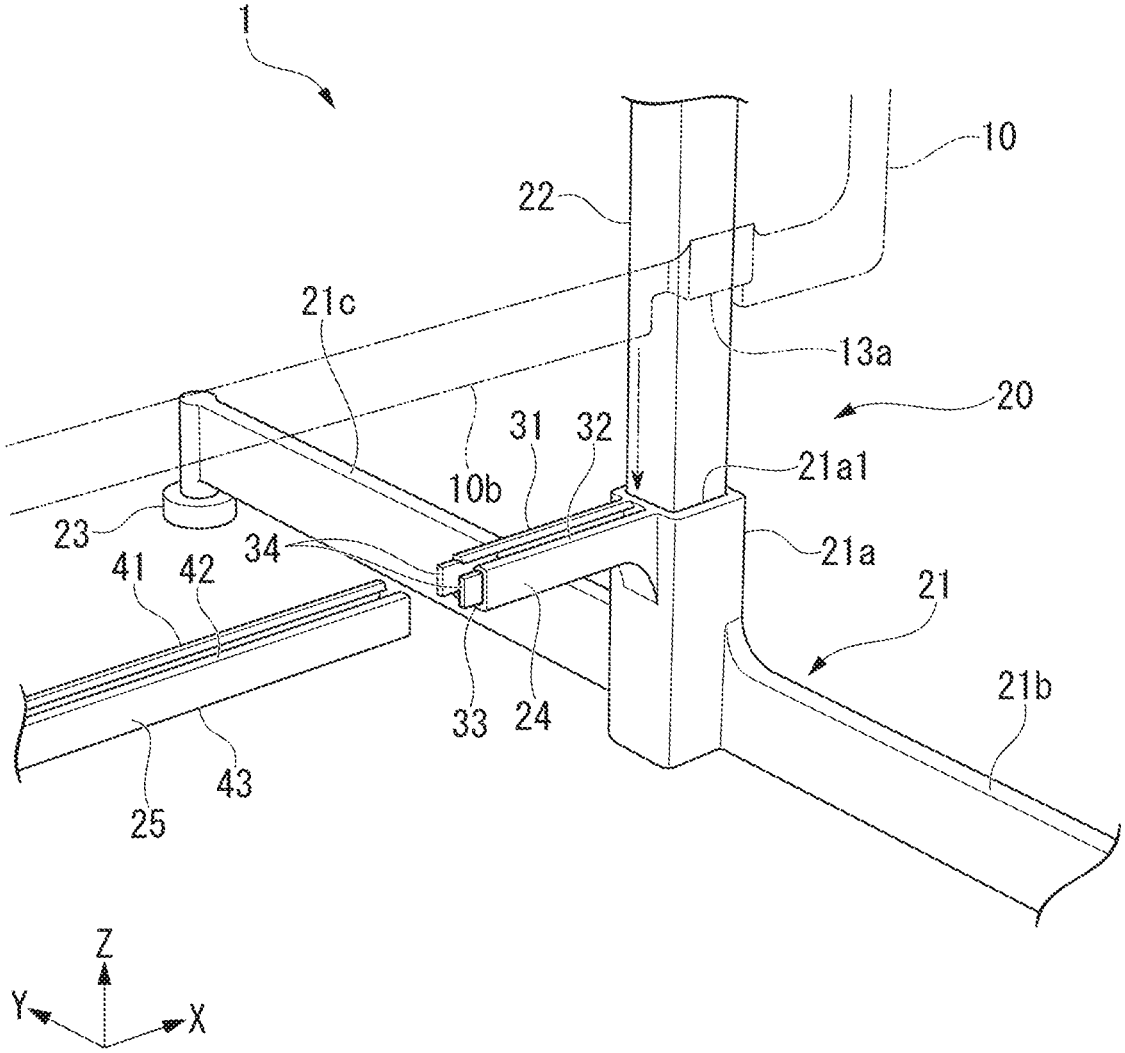
FIG. 3 is an exploded perspective view of a vicinity of a leg 20 of the panel 1 according to the embodiment of the present invention.
Figure 4:
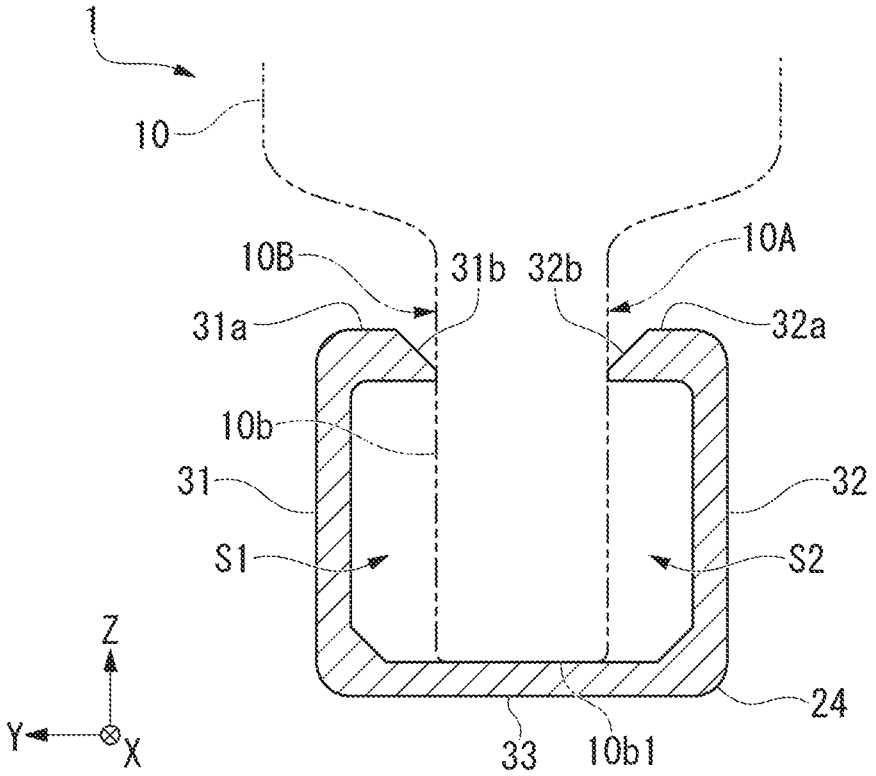
FIG. 4 is a cross-sectional view along line A-A in FIG. 1.
Figure 5:
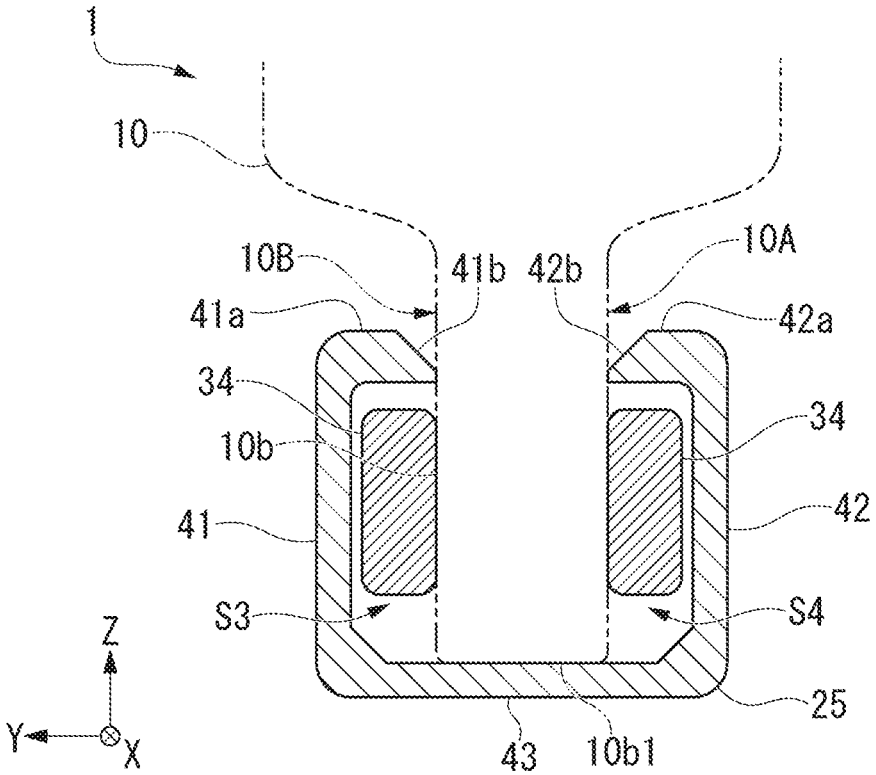
FIG. 5 is a cross-sectional view along line B-B in FIG. 1.

FIG. 3 is an exploded perspective view of a vicinity of the leg 20 of the panel 1 according to the embodiment of the present invention. FIG. 4 is a cross-sectional view along line A-A in FIG. 1. FIG. 5 is a cross-sectional view along line B-B in FIG. 1.

As shown in FIG. 3, the engagement recess 24 extends in the X axis direction parallel to an upper end surface of the fixing portion 21*a* of the leg body 21. Also, a fixing hole 21*a*1 for fixing the shaft 22 is formed in the upper end surface of the fixing portion 21*a*.

The engagement recess 24 is provided with a first rotation stopper 31 which comes into contact with either one of both panel surfaces of the panel body 10 (for example, the back surface 10B) and stops rotation of the panel body 10 about the shaft 22 in one direction (for example, clockwise in a plan view), and a second rotation stopper 32 which comes into contact with either one of both panel surfaces of the panel body 10 (for example, the front surface 10A) and stops rotation of the panel body 10 in a direction opposite to the one direction (for example, counterclockwise in a plan view).

That is, when the panel body 10 is made of a nonwoven fabric, relative rotation between the panel body 10 and the leg body 21 around the shaft 22 may occur even when the quadrangular pillar-shaped shaft 22 is inserted into the hollow portion 13 having a quadrangular shape in cross-section, and it is necessary to restrict such rotation. As shown in FIG. 4, the first rotation stopper 31 and the second rotation stopper 32 are brought into contact with the peripheral edge 10*b* of the panel body 10. The peripheral edge 10*b* has a thickness dimension smaller than those of other portions besides the peripheral edge 10*b* and has strength, and thus is suitable for stopping the rotation.

The first rotation stopper 31 and the second rotation stopper 32 extend substantially parallel to the front surface 10A and the back surface 10B of the peripheral edge 10*b*. Also, the first rotation stopper 31 and the second rotation stopper 32 are connected to each other at a connection portion 33 that is substantially parallel to an end surface 10*b*1 of the peripheral edge 10*b*. The first rotation stopper 31 and the second rotation stopper 32 stand upward in the same direction (upward in the vertical direction) from the connection portion 33 and form the engagement recess 24 having the connection portion 33 as a bottom surface.

Upper ends 31*a* and 32*a* of the first rotation stopper 31 and the second rotation stopper 32 of the present embodiment bend in directions to face each other and form an opening of the engagement recess 24 into which the peripheral edge 10*b* is inserted. Inclined surfaces 31*b* and 32*b* that are inclined downward toward respective tips of the upper ends 31*a* and 32*a* are formed in upper surfaces of the upper ends 31*a* and 32*a*. The inclined surfaces 31*b* and 32*b* have a guiding function for facilitating insertion of the peripheral edge 10*b* of the panel body 10 into the opening of the engagement recess 24.

Spaces S1 and S2 are formed below the upper ends 31*a* and 32*a*. Connecting portions 34 shown in FIG. 3 are provided in the spaces S1 and S2. The connecting portions 34 are rectangular plates and are provided to protrude from a tip of the engagement recess 24 in the longitudinal direction (X axis direction) of the engagement recess 24. The connecting portions 34 may be attached as separate members to inwardly face inner surfaces of the first rotation stopper 31 and the second rotation stopper 32, or may be formed integrally with the first rotation stopper 31 and the second rotation stopper 32.

The cover 25 is made of a resin and has a recessed shape that covers the peripheral edge 10*b* of the panel body 10. As shown in FIG. 5, the cover 25 has the same recessed shape as the engagement recess 24 described above. That is, a first wall 41 and a second wall 42 of the cover 25 extend substantially parallel to the front surface 10A and the back surface 10B of the peripheral edge 10*b* and are connected to each other at the connection portion 43 substantially parallel to the end surface 10*b*1 of the peripheral edge 10*b*. Also, the first wall 41 and the second wall 42 stand upward in the same direction (upward in the vertical direction) from the connection portion 43 and form a recessed shape having the connection portion 43 as a bottom surface.

Upper ends 41*a* and 42*a* of the first wall 41 and the second wall 42 bend in directions to face each other and clamp the peripheral edge 10*b* in the thickness direction. Inclined surfaces 41*b* and 42*b* are formed in upper surfaces of the upper ends 41*a* and 42*a*, respectively, and the peripheral edge 10*b* is easily guided and inserted therethrough. Spaces S3 and S4 are formed below the upper ends 41*a* and 42*a*. The connecting portions 34 are inserted into these spaces S3 and S4 (see FIGS. 3 and 5).

By inserting the connecting portions 34 into the spaces S3 and S4, as shown in FIG. 1, the engagement recess 24 and the cover 25 are connected to each other in the X axis direction. The pair of legs 20 are arranged with an interval therebetween in the width direction of the panel body 10, and both ends of the cover 25 are connected to respective tip portions of the engagement recesses 24 of the pair of legs 20 extending in directions to face each other.

According to the panel 1 having the above configuration, as shown FIGS. 1 to 3, by supporting the panel body 10 from the inside using the shaft 22 inserted into the panel body 10, falling over of the panel body 10 can be prevented. In addition, since the shaft 22 inserted into the panel body 10 is invisible from the outside, superior design characteristics can be realized. Further, a function of preventing the rotation of the panel body 10 is ensured by the leg body 21 disposed outside the panel body 10. In other words, the shaft 22 has the function (strength) of preventing falling over of the panel body 10 and the shaft 22 is provided not to be exposed outside the panel body 10.

As shown in FIGS. 3 and 4, the leg body 21 is provided with the first rotation stopper 31 which comes into contact with the back surface 10B of the panel surfaces of the panel body 10 and stops rotation of the panel body 10 in one direction about the shaft 22 and the second rotation stopper 32 which comes into contact with the front surface 10A of the panel surfaces of the panel body 10 and stops rotation of the panel body 10 in a direction opposite to the one direction. Since the first rotation stopper 31 and the second rotation stopper 32 do not need to have a strength for preventing falling over of the panel body 10, and just need to secure a strength for preventing rotation of the panel body 10, their sizes can be reduced and thus they can be inconspicuous when viewed from the outside.

Also, in the present embodiment, as shown in FIGS. 3 and 4, the first rotation stopper 31 and the second rotation stopper 32 come into contact with the peripheral edge 10*b* of the panel body 10. According to this configuration, as shown in FIG. 1, since the first rotation stopper 31 and the second rotation stopper 32 (the engagement recess 24) are disposed at the peripheral edge 10*b* forming the lower end side of the panel body 10, the first rotation stopper 31 and the second rotation stopper 32 can be more inconspicuous. For this reason, the panel 1 which has superior design characteristics and can prevent falling over and rotation of the panel body 10 can be obtained.

Also, in the present embodiment, as shown in FIG. 4, the first rotation stopper 31 and the second rotation stopper 32 extend substantially parallel to the front surface 10A and the back surface 10B of the peripheral edge 10*b* and are connected to each other at the connection portion 33 substantially parallel to the end surface 10*b*1 of the peripheral edge 10*b*. According to this configuration, in a state in which the peripheral edge 10*b* of the panel body 10 is inserted between the first rotation stopper 31 and the second rotation stopper 32, the end surface 10*b*1 of the peripheral edge 10*b* and the connection portion 33 can come into contact with each other substantially in parallel, and the interval between the first rotation stopper 31 and the second rotation stopper 32 is kept constant by the connection portion 33. Accordingly, the first rotation stopper 31 and the second rotation stopper 32 can stably come into contact with the front surface 10A and the back surface 10B of the peripheral edge 10*b*.

Also, in the present embodiment, as shown in FIG. 4, the first rotation stopper 31 and the second rotation stopper 32 stand upward in the same direction from the connection portion 33 and form the engagement recess 24 having the connection portion 33 as the bottom surface. According to this configuration, in a state in which the peripheral edge 10*b* of the panel body 10 is inserted into the engagement recess 24, the end surface 10*b*1 of the peripheral edge 10*b* and the connection portion 33 forming the bottom surface of the engagement recess 24 are located substantially at the same position. Accordingly, a design characteristic thereof is improved. Also, since the first rotation stopper 31, the second rotation stopper 32, and the connection portion 33 are connected to each other, the overall strength thereof is high, and the first rotation stopper 31 and the second rotation stopper 32 can be reduced in size and weight as compared to a case in which there is no connection portion 33.

Also, as shown in FIG. 3, the present embodiment includes the recess-shaped cover 25 that covers the peripheral edge 10*b* of the panel body 10, and the connecting portion 34 that connects the cover 25 to the engagement recess 24. According to this configuration, as shown in FIG. 1, since the cover 25 which covers the peripheral edge 10*b* of the panel body 10 can be connected continuously with the engagement recess 24, the design characteristic is improved while the peripheral edge 10*b* is protected by the cover 25.

Also, the present embodiment, as shown in FIG. 1, the pair of legs 20 are provided with an interval therebetween in the width direction of the panel body 10, and the first rotation stopper 31 and the second rotation stopper 32 of each of the pair of legs 20 extend in the directions to face each other. According to this configuration, since a shape of the pair of legs 20 becomes symmetrical in the width direction of the panel body 10, an appearance thereof is good, and the panel body 10 can be stably supported.

As described above, according to the present embodiment described above, the panel 1 which has the panel body 10 and the leg 20 which supports the panel body 10 adopts the configuration in which the leg 20 has the shaft 22 inserted into the panel body 10 and the leg body 21 to which the shaft 22 is fixed and which is disposed outside the panel body 10, and the leg body 21 is provided with the first rotation stopper 31 which comes into contact with at least either one of the front surface 10A and the back surface 10B of the panel surfaces of the panel body 10 and stops rotation of the panel body 10 in one direction about the shaft 22, and the second rotation stopper 32 which stops rotation of the panel body 10 in the direction opposite to the one direction, whereby the panel 1 which has superior design characteristics and can prevent falling over and rotation of the panel body 10 can be obtained.

As described above, a preferred embodiment of the present invention has been described with reference to the drawings, but the present invention is not limited to the above embodiment. Shapes, combinations, and the like of the respective constituent members shown in the embodiment described above are merely examples, and various modifications can be made on the basis of design requirements and the like without departing from the gist of the present invention.

For example, the present invention can adopt the following aspects. Also, in the following description, components the same as or equivalent to those in the above-described embodiment are denoted by the same reference numerals, and descriptions thereof will be simplified or omitted.

Figure 6:
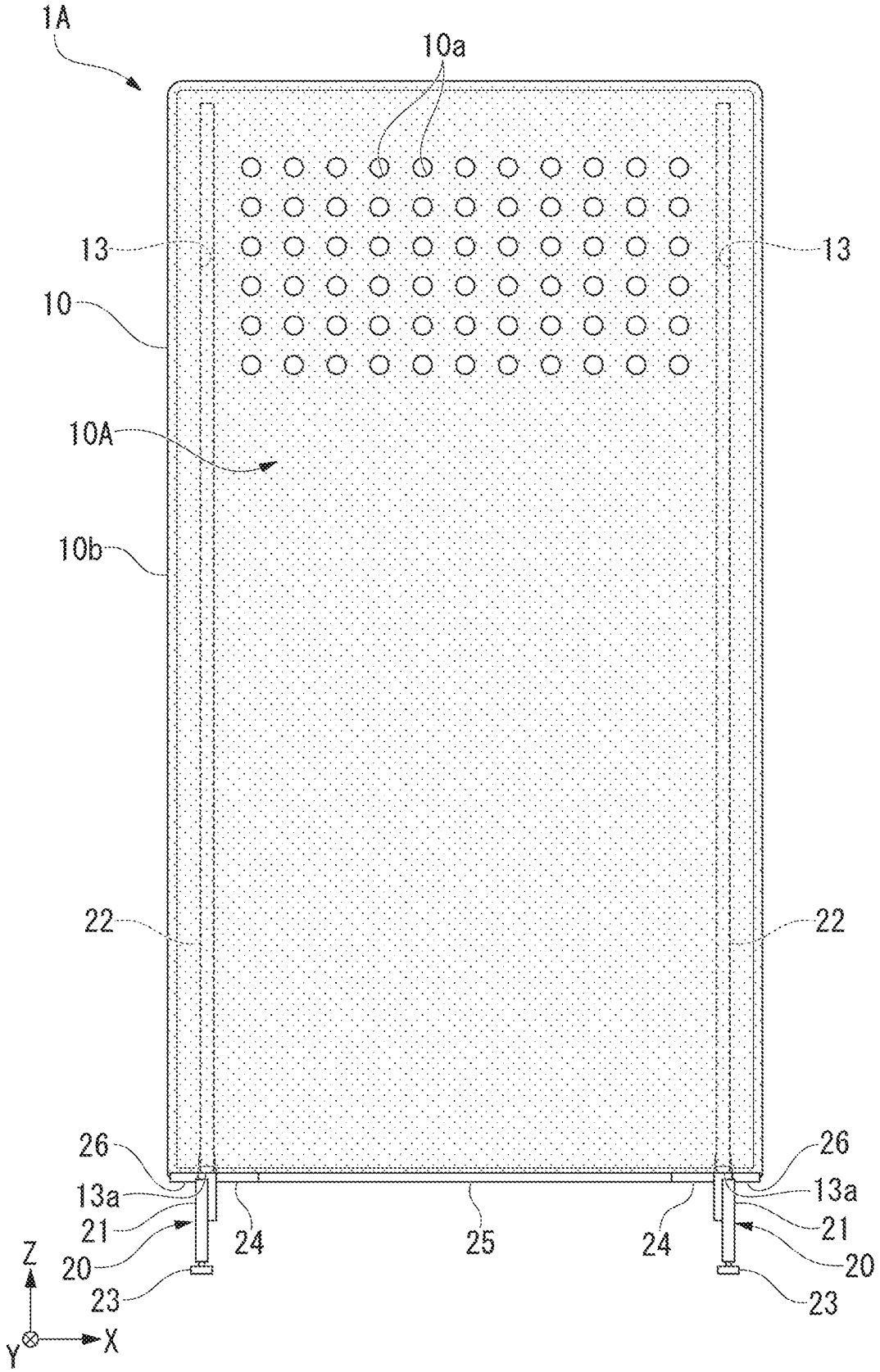
FIG. 6 is a front view of a panel 1A according to another embodiment of the present invention.
Figure 7:
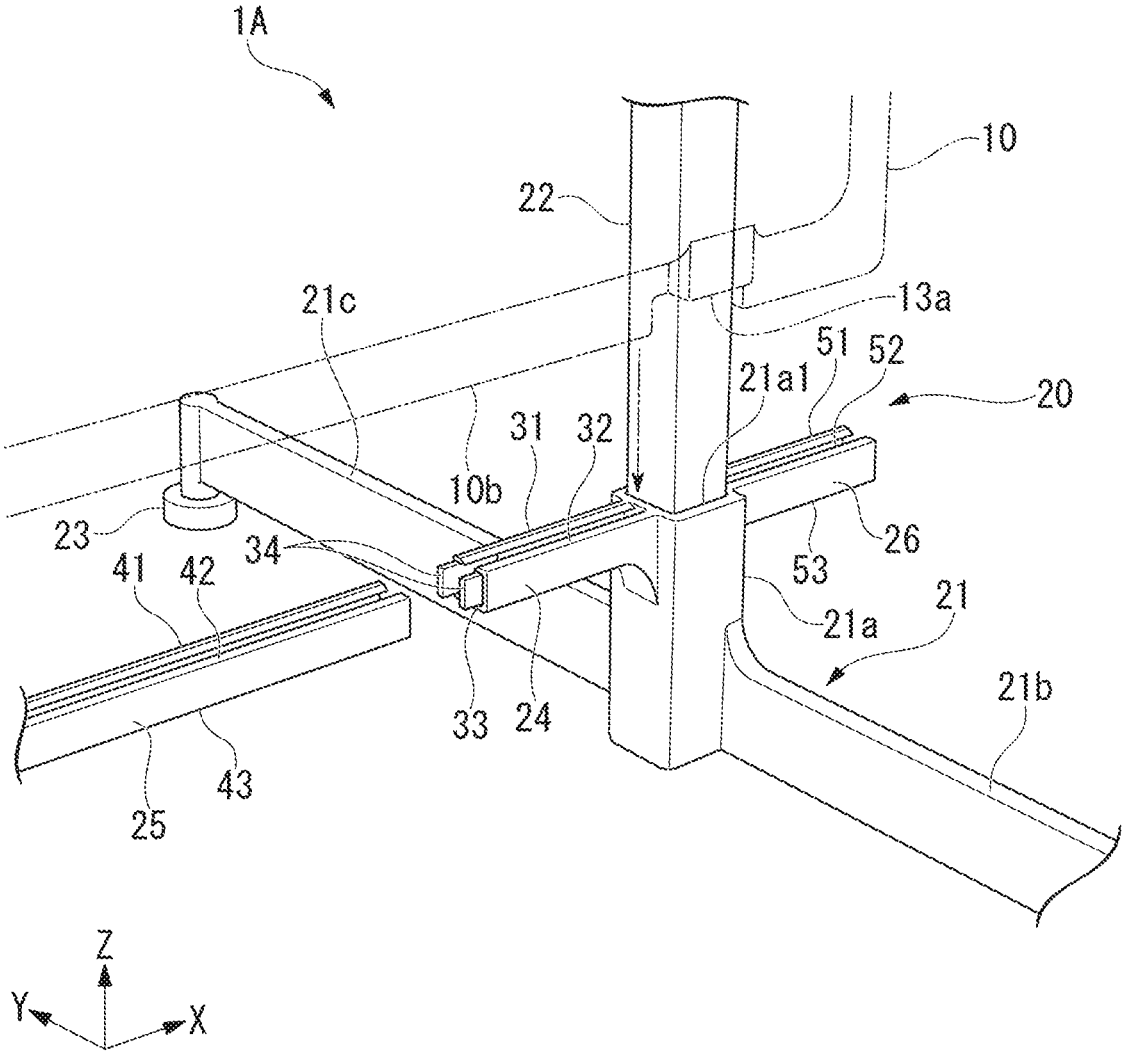
FIG. 7 is an exploded perspective view of a vicinity of a leg 20 of the panel 1A according to another embodiment of the present invention.

FIG. 6 is a front view of a panel 1A according to another embodiment of the present invention. FIG. 7 is an exploded perspective view of a vicinity of the leg 20 of the panel 1A according to another embodiment of the present invention.

For example, like the panel 1A shown in FIG. 6, second engagement recesses 26 extending from the pair of legs 20 in directions opposite to each other may be provided. As shown in FIG. 7, the second engagement recesses 26 extend symmetrically with the aforementioned engagement recesses 24 from the fixing portion 21*a*. Also, tips of the second engagement recesses 26 are configured not to protrude outward from both ends of the panel body 10 in the width direction.

Each of the second engagement recesses 26 has a first rotation stopper 51 which comes into contact with any one of the panel surfaces of the panel body 10 (for example, the back surface 10B) and stops rotation of the panel body 10 about the shaft 22 in one direction (for example, counterclockwise in a plan view), a second rotation stopper 52 which comes into contact with any one of the panel surfaces of the panel body 10 (for example, the front surface 10A) and stops rotation of the panel body 10 in a direction opposite to the one direction (for example, clockwise in a plan view), and a connection portion 53 which connects the first rotation stopper 51 and the second rotation stopper 52. However, unlike the above-described engagement recesses 24, the second engagement recesses 26 do not include the connecting portions 34.

Figure 8A:
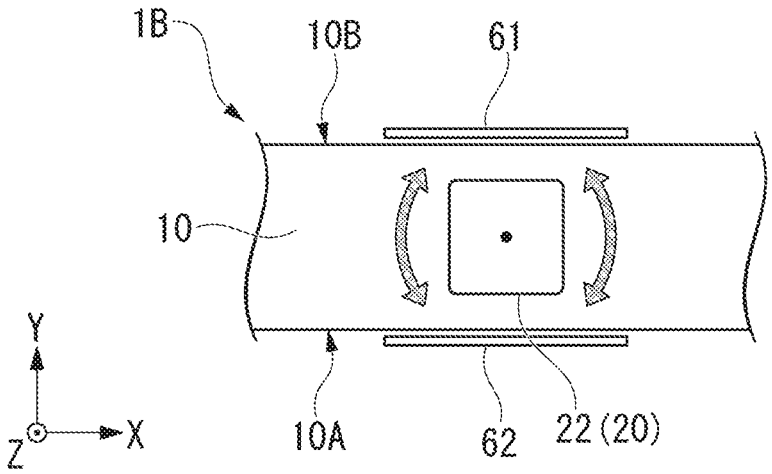
FIG. 8A is a conceptual diagram of a panel 1B according to another embodiment of the present invention viewed in a plan view.
Figure 8B:
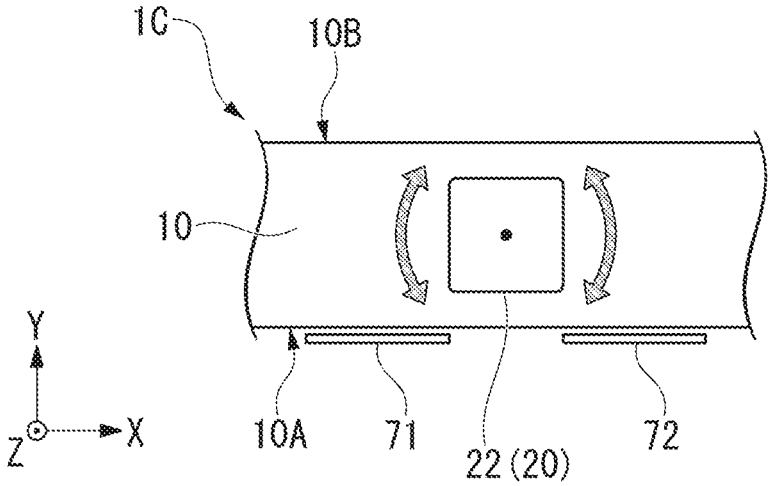
FIG. 8B is a conceptual diagram of a panel 1C according to another embodiment of the present invention viewed in a plan view.

FIG. 8A is a conceptual diagram of a panel 1B according to another embodiment of the present invention viewed in a plan view FIG. 8B is a conceptual diagram of a panel 1C according to another embodiment of the present invention as viewed in a plan view.

For example, like the panel 1B shown in FIG. 8A, a first rotation stopper 61 and a second rotation stopper 62 having plate shapes may be provided. The first rotation stopper 61 and the second rotation stopper 62 are not configured to have recess shapes and to be connected to each other as described above, but respectively stand upward from the leg body 21 and the like of the leg 20 and face to be able to come into contact with the front surface 10A and the back surface 10B of the panel body 10. Even with such a configuration, rotation of the panel body 10 about the shaft 22 (both clockwise and counterclockwise in a plan view) can be stopped. With this configuration, since rotation in both directions can also be stopped by both the first rotation stopper 61 and the second rotation stopper 62, the effect of stopping rotation of the panel body 10 about the shaft 22 is enhanced.

Also, for example, as in the panel 1C shown in FIG. 8B, each of a first rotation stopper 71 and a second rotation stopper 72 having a plate shape may be disposed to be able to come into contact with only either one of both panel surfaces of the panel body 10 (the front surface 10A in the example of FIG. 8B). Even in this case, by disposing the first rotation stopper 71 and the second rotation stopper 72 with a center of the shaft 22 interposed therebetween in the width direction (X axis direction) of the panel body 10, rotation of the panel body 10 about the shaft 22 (both clockwise and counterclockwise in a plan view) can be stopped. Further, the first rotation stopper 71 and the second rotation stopper 72 may be formed of a single plate and be connected to each other. Even with this configuration, rotation of the panel body 10 about the shaft 22 (both clockwise and counterclockwise in a plan view) can be stopped. In addition, with this configuration, since the rotation stoppers appear only on one surface of the panel body 10 (the front surface 10A in the example of FIG. 8B), members are invisible on the other surface (the back surface 10B in the example of FIG. 8B), so that a clean surface can be obtained. Also, the front surface 10A and the back surface 10B can have completely different appearances.

Also, for example, although the panel body is made of a nonwoven fabric in the above-described embodiments, the panel body may be configured of a plastic panel, a metal panel, or e like. Also, the hollow portion and the shaft of the leg formed in the panel body may be cylindrical.

Also, for example, although the first rotation stopper and the second rotation stopper are described as coming into contact with the peripheral edge forming the lower end side of the panel body in the above-described embodiments, the first rotation stopper and the second rotation stopper may be configured to come into contact with an upper end side of the panel body or a peripheral edge forming at least either one of left and right side edges.

INDUSTRIAL APPLICABILITY

The present invention can be widely used for panels used in offices and public facilities.

REFERENCE SIGNS LIST

1 Panel
1A Panel
1B Panel
1C Panel
10 Panel body
10A Front surface
10B Back surface
10*b* Peripheral edge
10*b*1 End surface
20 Leg
21 Leg body
22 Shaft
24 Engagement recess
25 Cover
31 First rotation stopper
32 Second rotation stopper
33 Connection portion
34 Connecting portion
51 First rotation stopper
52 Second rotation stopper
61 First rotation stopper
62 Second rotation stopper
71 First rotation stopper
72 Second rotation stopper

The invention claimed is:

1. A panel comprising:
a panel body; and
a leg which supports the panel body,
wherein the leg includes:
a shaft inserted into the panel body; and
a leg body to which the shaft is fixed and which is disposed outside the panel body, and
the leg body is provided with:
a first rotation stopper which is configured to come into contact with either one of opposing panel surfaces of the panel body and stop rotation of the panel body in one direction around the shaft; and
a second rotation stopper which is configured to come into contact with either one of the opposing panel surfaces of the panel body and stop rotation of the panel body in a direction opposite to the one direction.

2. The panel according to claim 1, wherein the first rotation stopper and the second rotation stopper are configured to come into contact with a peripheral edge of the panel body.

3. The panel according to claim 2, wherein the first rotation stopper and the second rotation stopper extend substantially parallel to opposing surfaces of the peripheral edge and are connected to each other at a connection portion substantially parallel to an end surface of the peripheral edge.

4. The panel according to claim 3, wherein the first rotation stopper and the second rotation stopper stand upward in a same direction from the connection portion and form an engagement recess having the connection portion as a bottom surface.

5. The panel according to claim 4 further comprising:
a recess-shaped cover which covers the peripheral edge of the panel body; and
a connecting portion which connects the cover to the engagement recess.

6. The panel according to claim 1,
wherein the leg is each one of a pair of legs that are provided with an interval therebetween in a width direction of the panel body, and
the first rotation stopper and the second rotation stopper of each one of the pair of legs extend in directions to face each other.

* * * * *